US008416136B2

(12) United States Patent
Lo et al.

(10) Patent No.: US 8,416,136 B2
(45) Date of Patent: Apr. 9, 2013

(54) MODIFICATION ON MONOPOLE ANTENNA

(75) Inventors: Wen-Yuan Lo, Jung-He (TW); Cheng-Hsu Yang, Jung-He (TW); Yueh-Cheng Chen, Jung-He (TW)

(73) Assignee: Micro-Star Int'l Co., Ltd., Jung-He (TW)

( * ) Notice: Subject to any disclaimer, the term of this patent is extended or adjusted under 35 U.S.C. 154(b) by 369 days.

(21) Appl. No.: 12/939,448

(22) Filed: Nov. 4, 2010

(65) Prior Publication Data

US 2012/0026044 A1 Feb. 2, 2012

(30) Foreign Application Priority Data

Jul. 28, 2010 (TW) ..... 99214403 U

(51) Int. Cl.
*H01Q 1/38* (2006.01)

(52) U.S. Cl.
USPC ..... 343/700 MS

(58) Field of Classification Search ..... 343/700 MS, 343/702, 846, 834
See application file for complete search history.

(56) References Cited

U.S. PATENT DOCUMENTS 7,619,569 B2 * 11/2009 Wu et al. ..... 343/700 MS
2011/0254738 A1 * 10/2011 Chiu et al. ..... 343/700 MS

* cited by examiner

*Primary Examiner* — Hoang V Nguyen
(74) *Attorney, Agent, or Firm* — Ditthavong Mori & Steiner, P.C.

(57) ABSTRACT

A monopole antenna is disposed on a substrate including a first surface and a second surface. The monopole antenna includes a feeding point, a radiation unit, and a reflecting element. The radiation unit is disposed on the first surface of the substrate, and includes a feeding section, a first radiation section, a second radiation section, and a third radiation section. The feeding section, the first radiation section, and the second radiation section are connected sequentially. The feeding point is electrically connected to the feeding section. The second radiation section and the feeding section are respectively placed at two sides of a longitudinal axis of the first radiation section. The third radiation section is electrically connected to the first radiation section. The reflecting element is disposed on the second surface of the substrate, and corresponds to a position of the second radiation section.

10 Claims, 10 Drawing Sheets

MODIFICATION ON MONOPOLE ANTENNA

CROSS-REFERENCES TO RELATED APPLICATIONS

This non-provisional application claims priority under 35 U.S.C. §119(a) on Patent Application No. 99214403 filed in Taiwan, R.O.C. on 2010 Jul. 28, the entire contents of which are hereby incorporated by reference.

BACKGROUND OF THE INVENTION

1. Technical Field

The present invention relates to an antenna, and more particularly to a monopole antenna.

2. Related Art

An antenna is a necessary element in a wireless communication device, and in despite of continuous development of communication technologies, the antenna is still indispensable. With the fast development of wireless communication from a low frequency to a high frequency, an application scope thereof is developed from national defense communication and military application to communication networks and consumer electronic products, and a matching antenna is also developed from an exposed antenna to a light, thin, short, and small hidden antenna. It may be known that the wireless communication is inseparable from lives. When the communication device adopts a hidden antenna, a volume of the product is reduced, and the user cannot perceive an antenna structure from the appearance, so as to eliminate fears of the user for electromagnetic waves.

For a single feed and printed micro-strip antenna, a required antenna length is wavelength of an operating frequency. For a frequency band of 2.4 GHz commonly used in a wireless network, the required antenna length is approximately 30 mm. The current consumer electronic product is required to be light, thin, short, and small, which are keys that limit the volume of the electronic product, so it is still an urgent subject for modification on how to reduce a space occupied by the antenna.

SUMMARY

Accordingly, the present invention is mainly directed to a monopole antenna, so as to alleviate disadvantages of a conventional antenna, thereby reducing a space occupied by the antenna.

The present invention provides a monopole antenna disposed on a substrate with a first surface and a second surface. The monopole antenna includes: a feeding point, disposed on the first surface of the substrate, for inputting and outputting electrical signals corresponding to the electromagnetic-wave signals; a radiation unit, disposed on the first surface of the substrate; and a reflecting element, disposed on the second surface of the substrate, and corresponding to a position of the second radiation section. The radiation unit includes: a feeding section, having one end electrically connected to the feeding point; a first radiation section, having one end electrically connected to the other end of the feeding section; a second radiation section, having one end electrically connected to the other end of the first radiation section, in which the second radiation section and the feeding section are respectively placed at two sides of a longitudinal axis of the first radiation section; and a third radiation section, having one end electrically connected to the first radiation section, in which the third radiation section and the feeding section are respectively placed at the two sides of the longitudinal axis of the first radiation section.

Preferred embodiments and efficacies of the present invention are described below with reference to the accompanying drawings.

BRIEF DESCRIPTION OF THE DRAWINGS

The present invention will become more fully understood from the detailed description given herein below for illustration only, and thus are not limitative of the present invention, and wherein.

DETAILED DESCRIPTION

Figure 1A:
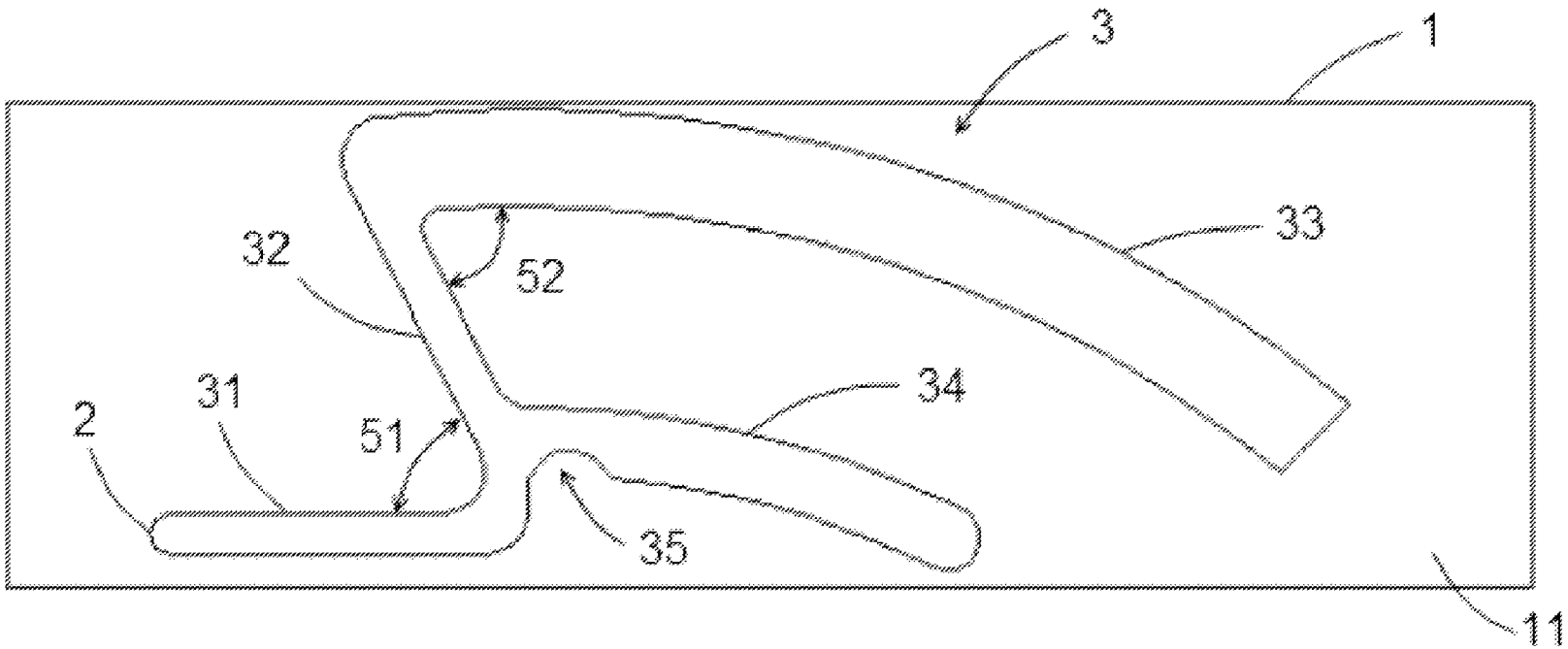
FIG. 1*a* is a schematic view of a first surface according to an embodiment of the present invention.

The present invention is described in detail with reference to the specific embodiments, and the accompanying drawings are used for auxiliary description. Numerals mentioned in the description are referred to the reference numerals.

Figure 1B:
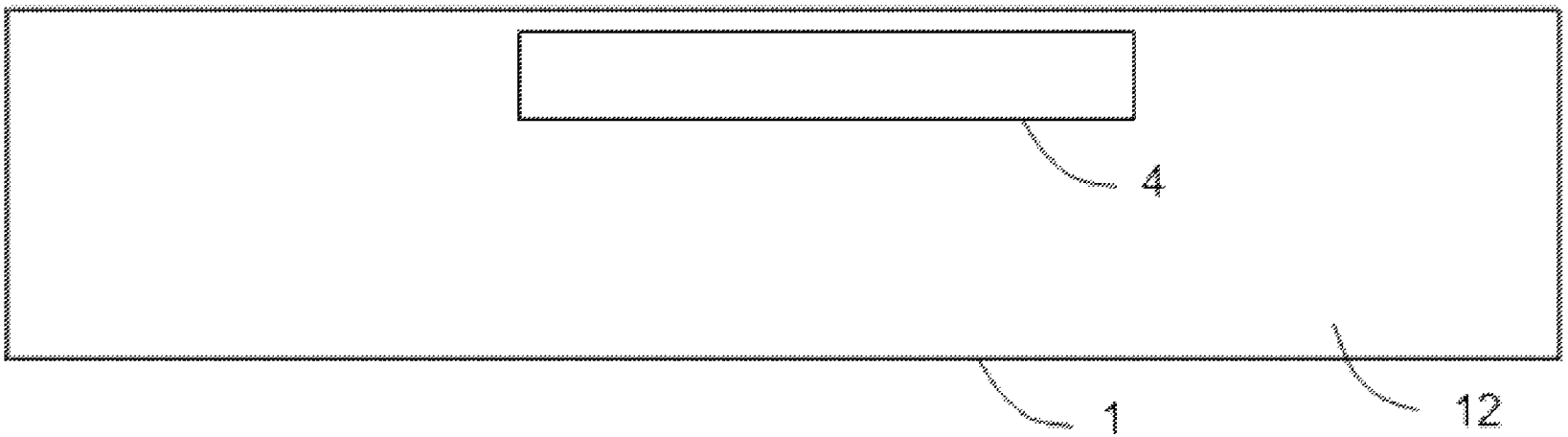
FIG. 1*b* is a schematic view of a second surface according to the embodiment of the present invention.

FIGS. 1*a* and 1*b* are schematic views according to an embodiment of the present invention. In the embodiment, the present invention provides a monopole antenna applicable to a wireless network, and more particularly to a wireless network card. Here, the frequency of the electromagnetic-wave signals is preferably 2.4 GHz, but the present invention is not limited hereto.

The monopole antenna is disposed on the substrate 1 with a first surface 11 and a second surface 12. FIG. 1*a* is a schematic view of the first surface 11 according to the embodiment of the present invention, and FIG. 1*b* is a schematic view of the second surface 12 according to the embodiment of the present invention. The monopole antenna includes a feeding point 2, a radiation unit 3, and a reflecting element 4. The radiation unit 3 and the reflecting element 4 are made of conductive material, and the substrate 1 is made of non-conductive material which may be substantially implemented through a printed circuit board.

Referring to FIG. 1*a*, the feeding point 2 is disposed on the first surface 11 of the substrate 1 and used for inputting and outputting electrical signals corresponding to the electromagnetic-wave signals. The radiation unit 3 is also disposed on the first surface 11 of the substrate 1, and includes a feeding section 31, a first radiation section 32, a second radiation section 33, and a third radiation section 34. One end of the feeding section 31 is electrically connected to the feeding point 2, and one end of the first radiation section 32 is electrically connected to the other end of the feeding section 31. One end of the second radiation section 33 is electrically connected to the other end of the first radiation section 32.

The second radiation section 33 and the feeding section 31 are respectively placed at two sides of a longitudinal axis of the first radiation section 32. One end of the third radiation section 34 is electrically connected to the first radiation section 32. The third radiation section 34 and the feeding section 31 are respectively placed at the two sides of the longitudinal axis of the first radiation section 32.

Here, the first radiation section 32 and the feeding section 31 form a first included angle 51, and the first radiation section 32 and the second radiation section 33 form a second included angle 52, in which both the first included angle 51 and the second included angle 52 are acute angles. The second radiation section 33 and the third radiation section 34 of the monopole antenna are substantially respectively a part of two concentric circles, that is, the second radiation section 33 and the third radiation section 34 are bent towards the same direction, and are in parallel with each other. Particularly, a circle center of the concentric circles is located near the third radiation section 34. A length ratio of the third radiation section 34 to the second radiation section 33 is between 50% and 80%, and preferably ⅔. Through the design, a space occupied by the radiation unit 3 is effectively reduced.

A total length of the feeding section 31, the first radiation section 32, and the second radiation section 33 according to the embodiment of the present invention is 10 mm. That is to say, as compared with the prior art, the length is approximately reduced by ⅔. However, as the length is reduced, inductive composition of the antenna is reduced. In the present invention, a current flow is changed by the second included angle 52, and then an inductance value is increased by the third radiation section 34 extended from the second radiation section 33. Next, a notch 35 is disposed at a connection position between the first radiation section 32 and the third radiation section 34, thereby adjusting a capacitance value. Here, the notch 35 may be located at an opposite side of the second radiation section 33.

Referring to FIG. 1*b*, the reflecting element 4 is disposed on the second surface 12 of the substrate 1, and corresponds to a position of the second radiation section 33, so as to generate a coupling effect, thereby achieving impedance matching of the monopole antenna. Here, the reflecting element 4 may be rectangular, and a longitudinal axis of the reflecting element 4 is slightly in parallel with the second radiation section 33, thereby achieving the preferred coupling effect.

Figure 2:
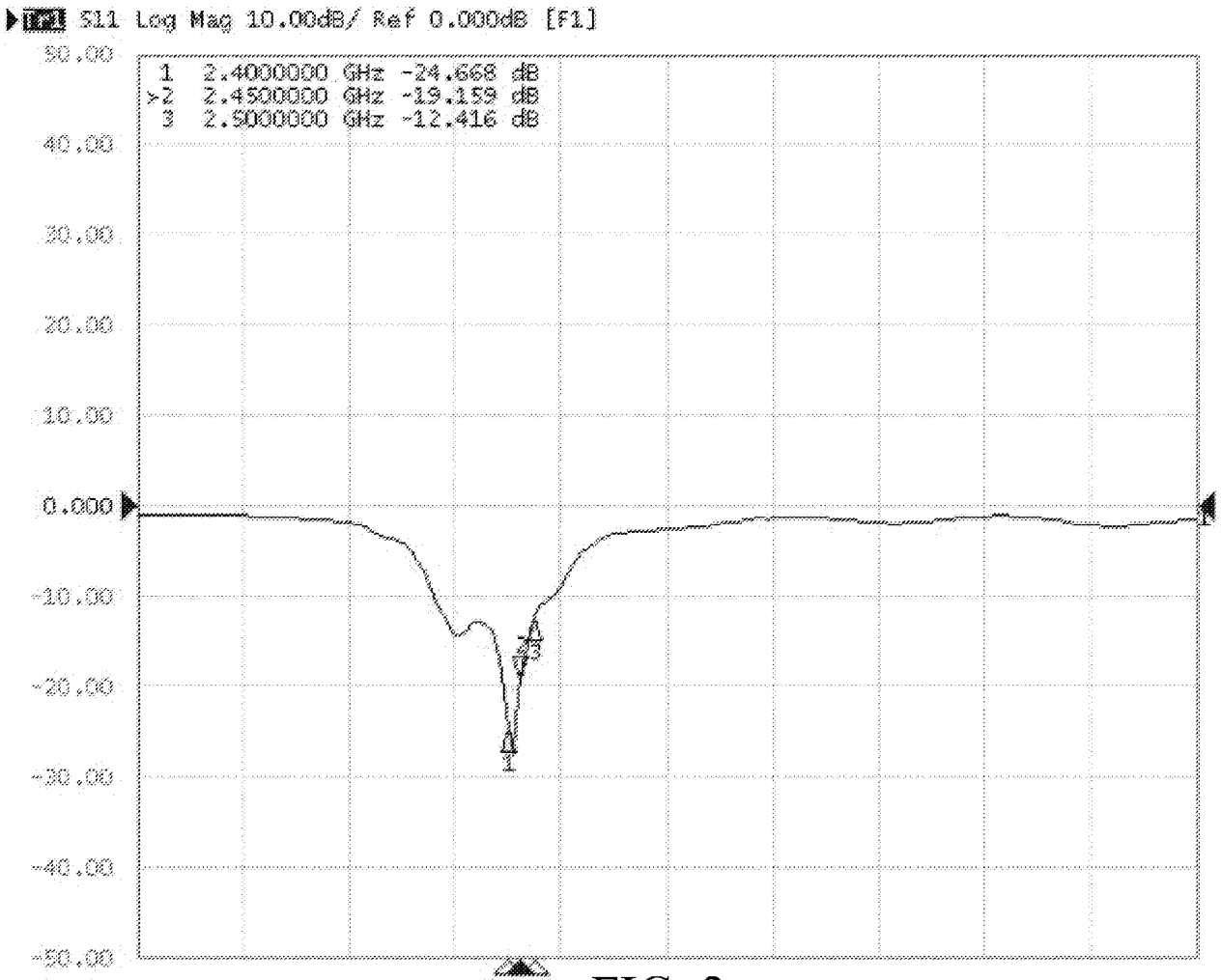
FIG. 2 is a schematic view of the return loss vs. the frequency according to the embodiment of the present invention.
Figure 3:
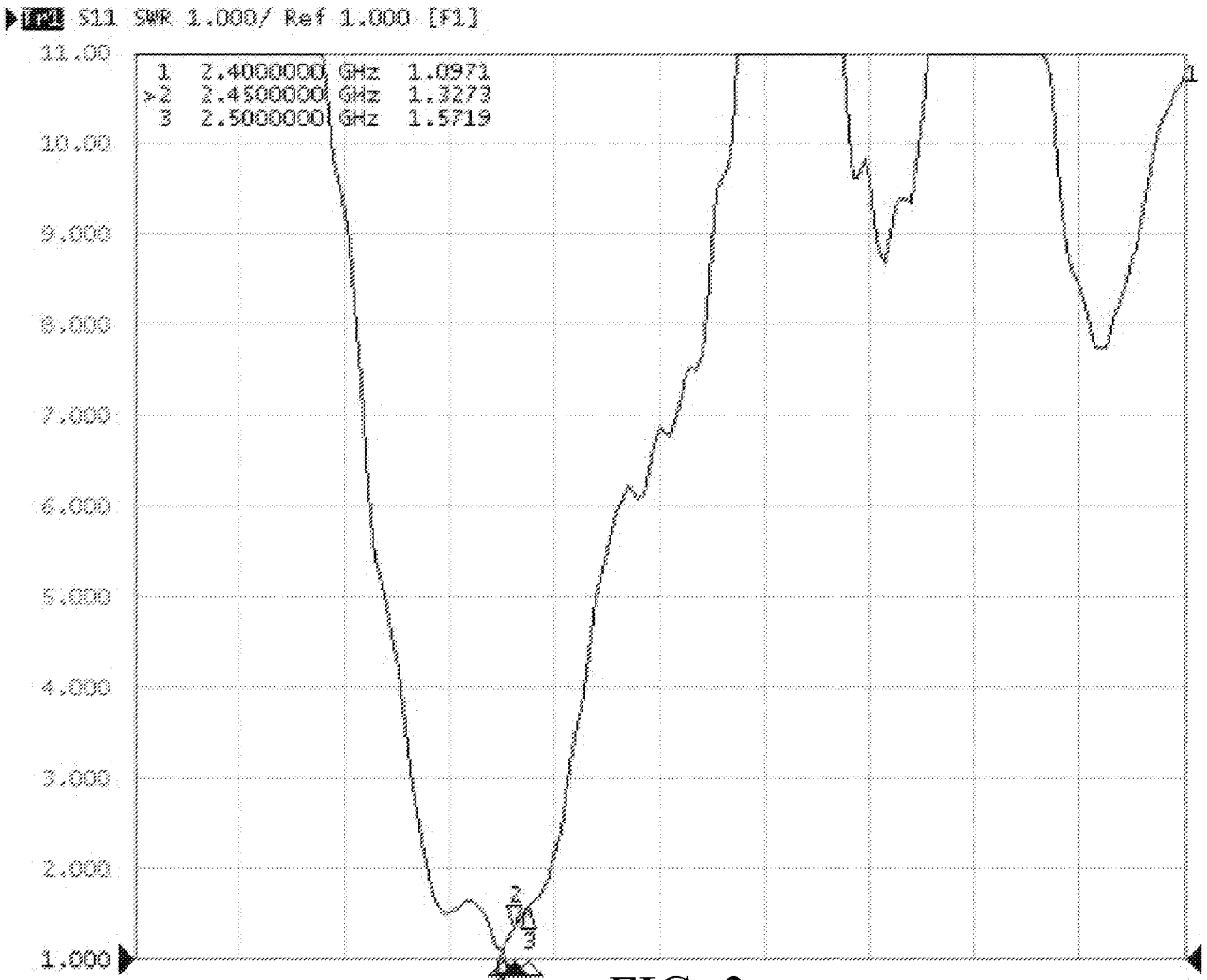
FIG. 3 is a schematic view of the voltage standing wave ratio (VSWR) vs. the frequency according to the embodiment of the present invention.

FIGS. 2 and 3 are schematic views of the return loss vs. the frequency and the VSWR vs. the frequency according to the embodiment of the present invention. The monopole antenna according to the embodiment of the present invention functions at frequency bands from 2.4 GHz to 2.5 GHz, and preferably at the frequency of 2.4 GHz.

Figure 4:
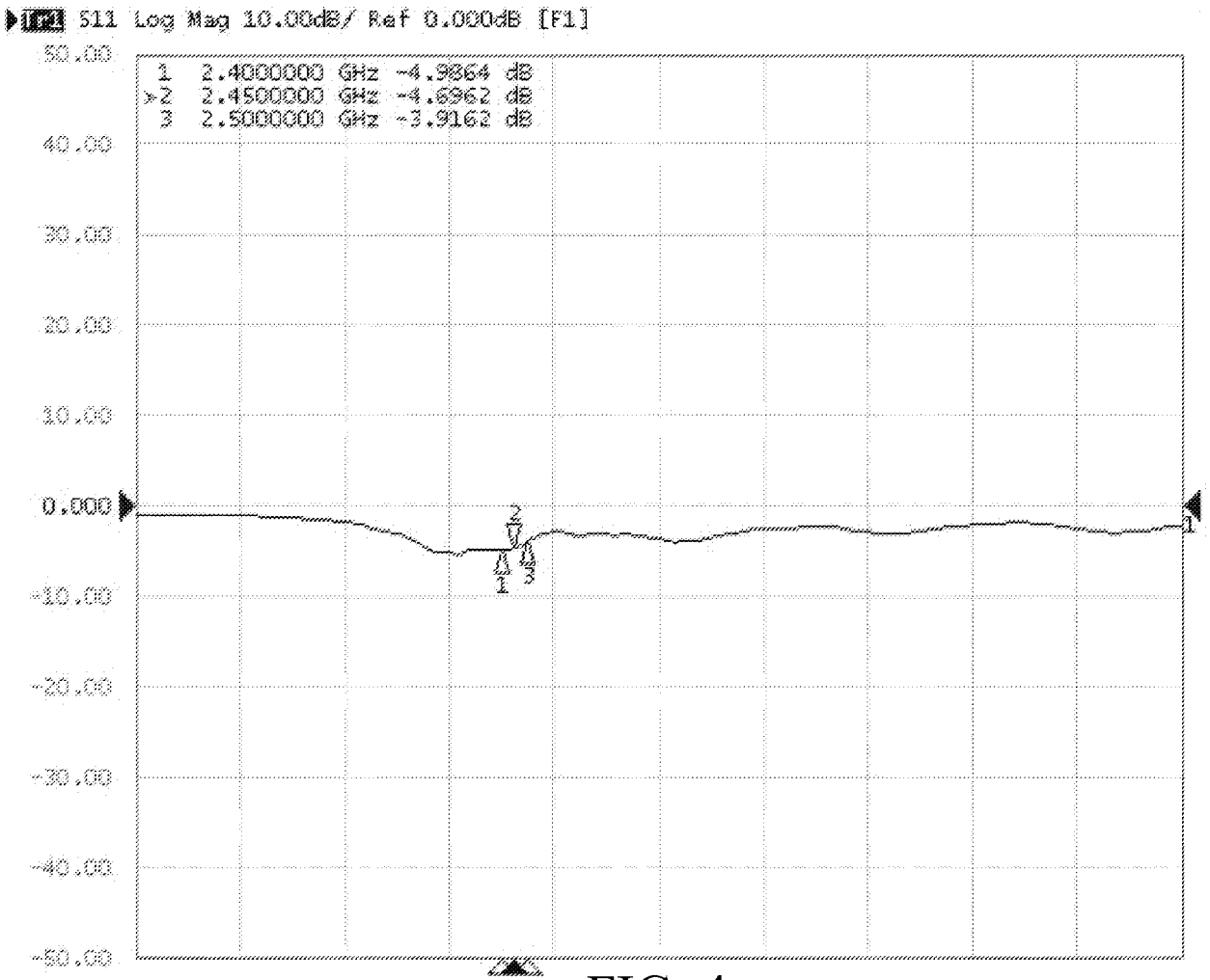
FIG. 4 is a schematic view of the return loss vs. the frequency according to the embodiment of the present invention of removing the third radiation section.
Figure 5:
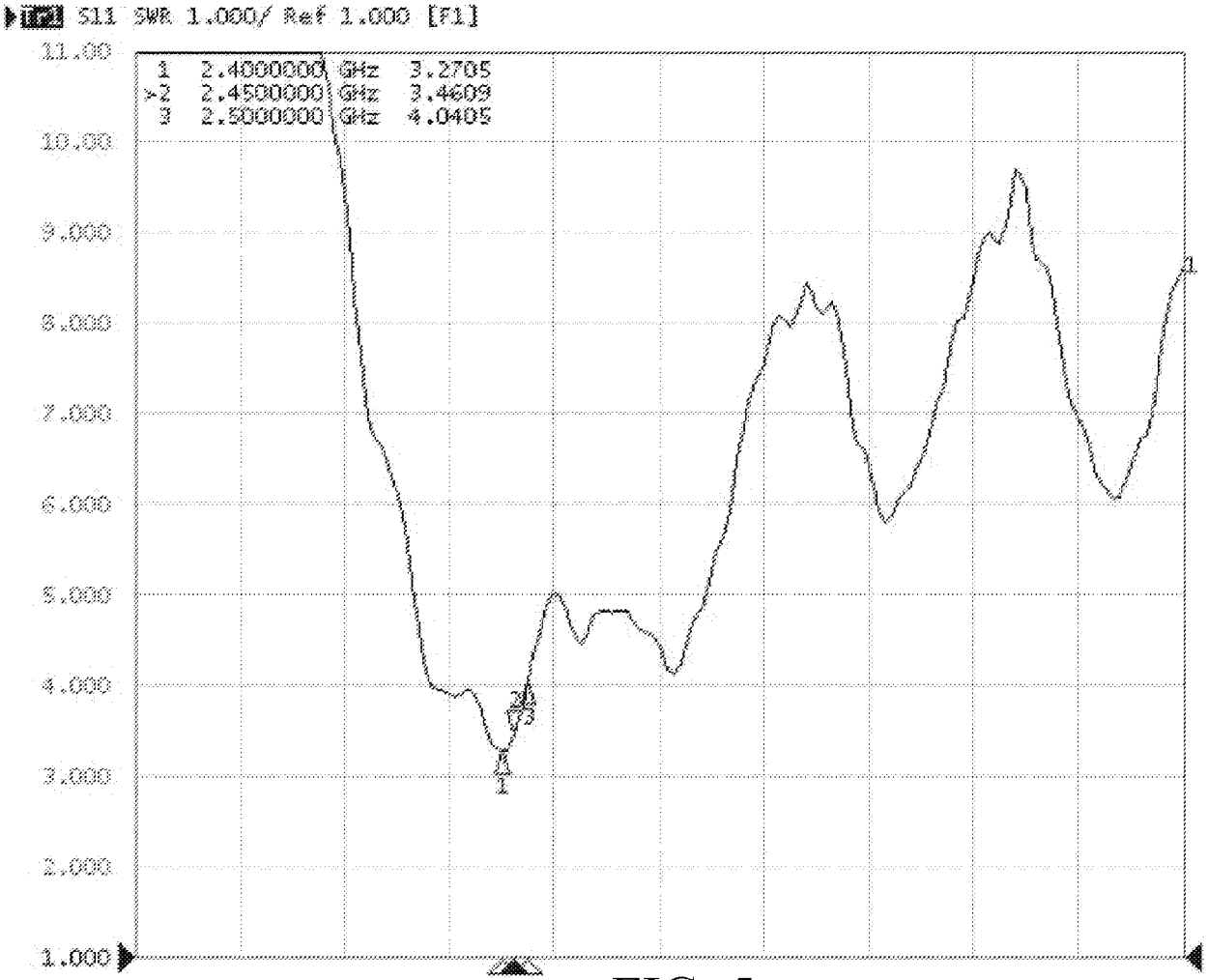
FIG. 5 is a schematic view of the VSWR vs. the frequency according to the embodiment of the present invention of removing the third radiation section.

FIGS. 4 and 5 are schematic views of the return loss vs. the frequency and the VSWR vs. the frequency of the third radiation section 34 according to the embodiment of the present invention of removing the third radiation section. When the third radiation section 34 with extended branches is not added, effects of the embodiment of the present invention cannot be achieved. It is known that in the embodiment of the present invention, the capacitance value and the inductance value are adjusted through the third radiation section 34 and the notch 35, such that after the length is reduced by ⅔, the monopole antenna still works at the frequency of 2.4 GHz.

Figure 6:
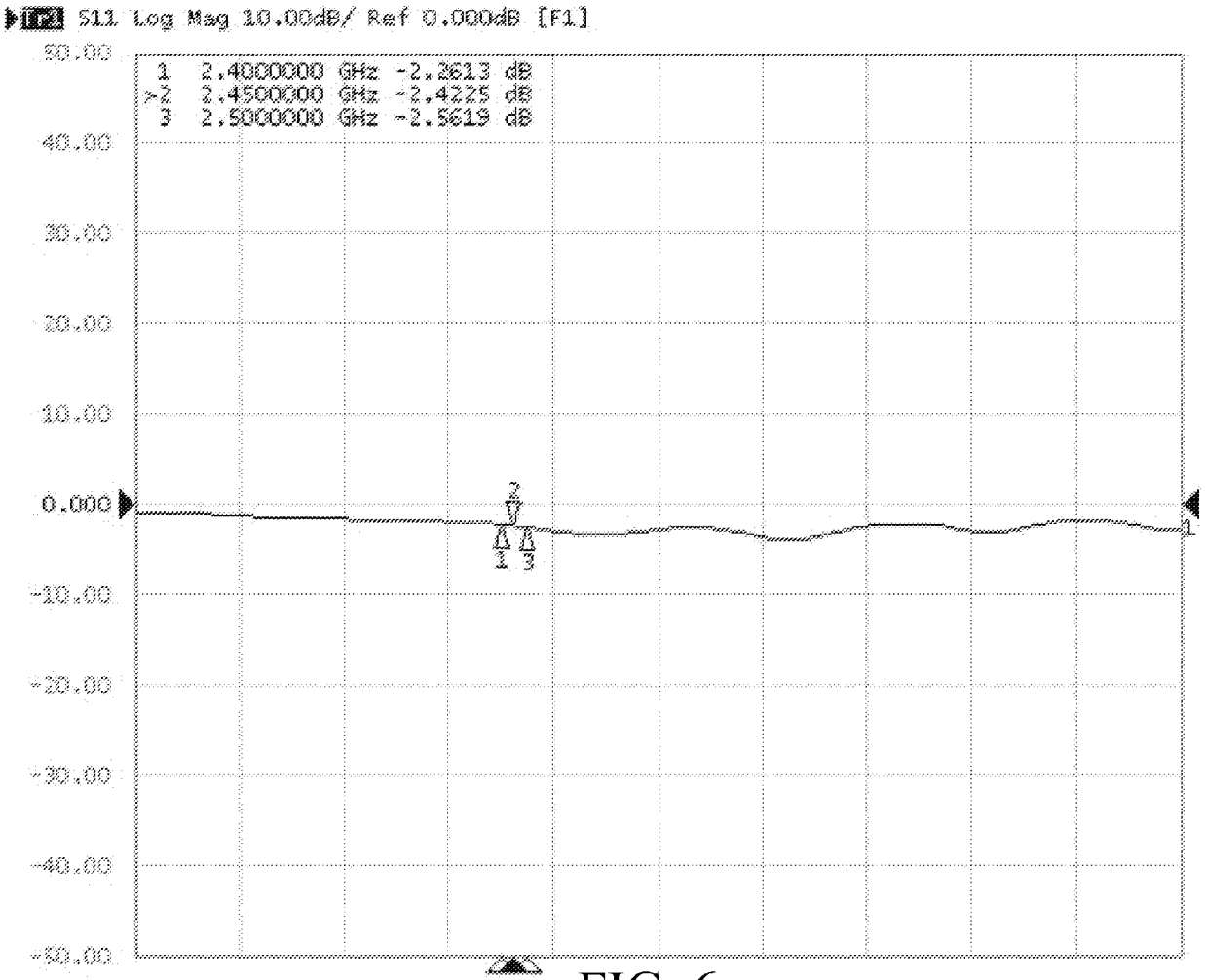
FIG. 6 is a schematic view of the return loss vs. the frequency according to the embodiment of the present invention of removing the reflecting element.
Figure 7:
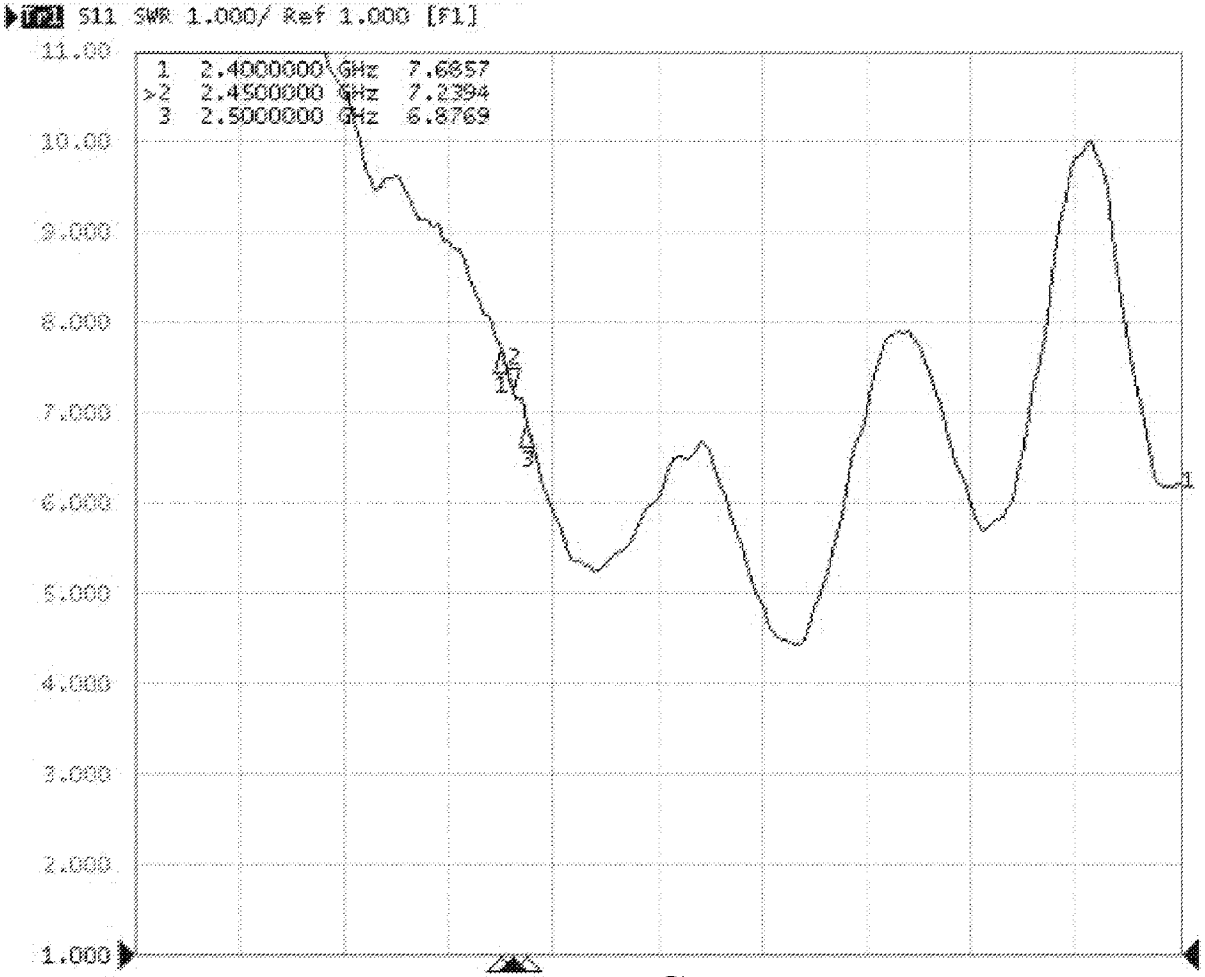
FIG. 7 is a schematic view of the VSWR vs. the frequency according to the embodiment of the present invention of removing the reflecting element.

FIGS. 6 and 7 are schematic views of the return loss vs. the frequency and the VSWR vs. the frequency according to the embodiment of the present invention of removing the reflecting element 4. When the reflecting element 4 is not added, effects of the embodiment of the present invention cannot be achieved. It is known that in the embodiment of the present invention, the impedance matching of the antenna is adjusted through the reflecting element 4, such that after the length is reduced by ⅔, the monopole antenna still works at the frequency of 2.4 GHz.

Figure 8:
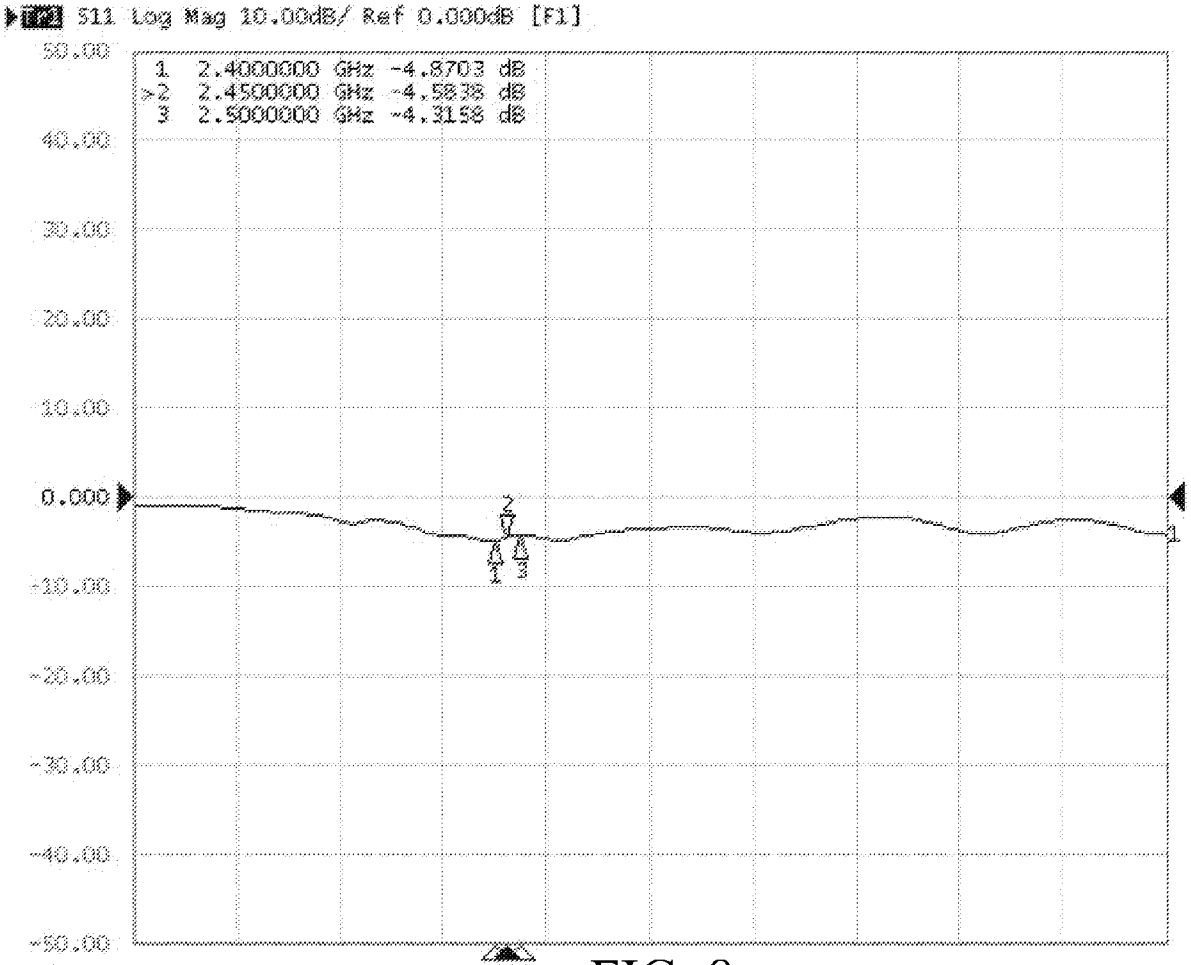
FIG. 8 is a schematic view of the return loss vs. the frequency according to the embodiment of the present invention when the reflecting element corresponds to a third radiation section.
Figure 9:
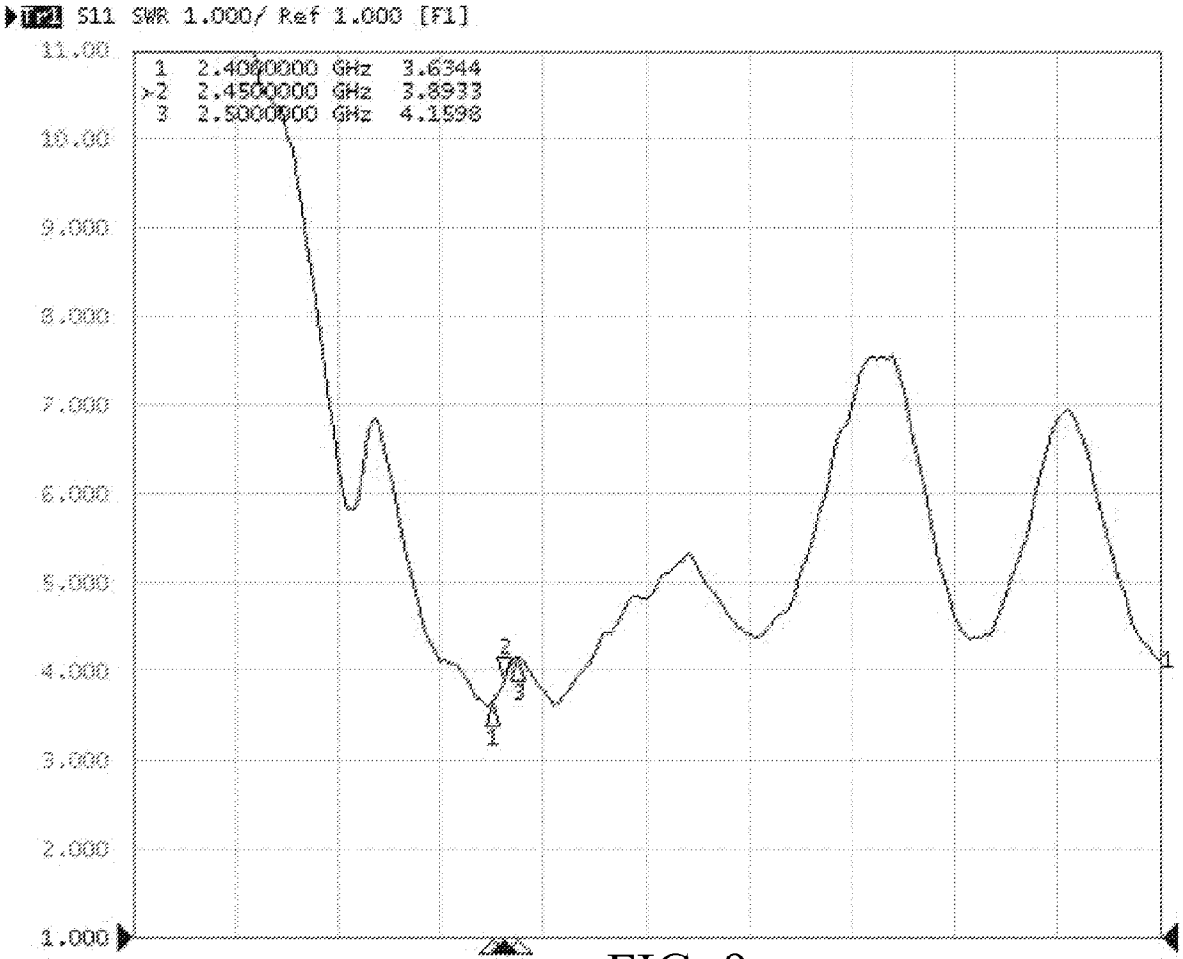
FIG. 9 is a schematic view of the VSWR vs. the frequency according to an embodiment of the present invention when a reflecting element corresponds to a third radiation section.

FIGS. 8 and 9 are schematic views of the return loss vs. the frequency and the VSWR vs.

the frequency according to the embodiment of the present invention when the reflecting element 4 corresponds to the position of the third radiation section 34. When the reflecting element 4 corresponds to the position of the third radiation section 34, as an operating frequency band of the monopole antenna according to the embodiment of the present invention is determined by the second radiation section 33 and the reflecting element 4, effects of the embodiment of the present invention cannot be achieved.

To sum up, through the present invention, the monopole antenna having the smaller length is surely provided, thereby facilitating to add more elements with other functions in the consumer electronic product or reduce the volume of the consumer electronic product under the limited volume situation.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A monopole antenna disposed on a substrate with a first surface and a second surface, comprising:

a feeding point disposed on the first surface of the substrate, inputting and outputting electrical signals corresponding to the electromagnetic-wave signals;

a radiation unit disposed on the first surface of the substrate, comprising:

a feeding section, having one end electrically connected to the feeding point;

a first radiation section, having one end electrically connected to the other end of the feeding section;

a second radiation section, having one end electrically connected to the other end of the first radiation section, wherein the second radiation section and the feeding section are respectively placed at two sides of a longitudinal axis of the first radiation section; and a third radiation section, having one end electrically connected to the first radiation section, wherein the third radiation section and the feeding section are respectively placed at the two sides of the longitudinal axis of the first radiation section; and a reflecting element, disposed on the second surface of the substrate, and corresponding to a position of the second radiation section.

2. The monopole antenna according to claim 1, wherein the first radiation section and the feeding section form a first comprised angle being an acute angle.

3. The monopole antenna according to claim 1, wherein the first radiation section and the second radiation section form a second comprised angle being an acute angle.

4. The monopole antenna according to claim 1, wherein the third radiation section and the second radiation section are respectively a part of two concentric circles, and a circle center of the two concentric circles is located near the third radiation section.

5. The monopole antenna according to claim 1, wherein a length ratio of the third radiation section to the second radiation section is between 50% and 80%.

6. The monopole antenna according to claim 1, wherein a notch is disposed at a connection position between the first radiation section and the third radiation section.

7. The monopole antenna according to claim 6, the notch is located at an opposite side of the second radiation section.

8. The monopole antenna according to claim 1, wherein the reflecting element is rectangular, and a longitudinal axis of the reflecting element is slightly in parallel with the second radiation section.

9. The monopole antenna according to claim 1, wherein the radiation unit and the reflecting element are made of conductive material, and the substrate is made of non-conductive material.

10. The monopole antenna according to claim 1, wherein a frequency of the electromagnetic-wave signals is 2.4 GHz.

* * * * *

UNITED STATES PATENT AND TRADEMARK OFFICE

CERTIFICATE OF CORRECTION

PATENT NO. : 8,416,136 B2
APPLICATION NO. : 12/939448
DATED : April 9, 2013
INVENTOR(S) : Wen-Yuan Lo et al.

It is certified that error appears in the above-identified patent and that said Letters Patent is hereby corrected as shown below:

Title Page, Item (73) Assignee: "Micro-Star Int'l Co., Ltd, Jung-He (TW)" should read --MSI Computer (Shenzhen) Co., Ltd. (CN)--.

Signed and Sealed this
Twentieth Day of August, 2013

Teresa Stanek Rea
*Acting Director of the United States Patent and Trademark Office*